United States Patent [19]

Lin

[11] Patent Number: 5,040,457

[45] Date of Patent: Aug. 20, 1991

[54] PRINTING PRESS DAMPENER

[75] Inventor: Jiing-Kang Lin, Lisle, Ill.

[73] Assignee: Rockwell International Corporation, Pittsburgh, Pa.

[21] Appl. No.: 419,179

[22] Filed: Oct. 10, 1989

[51] Int. Cl.[5] ..... B41L 25/06

[52] U.S. Cl. ..... 101/147; 101/366; 239/433

[58] Field of Search ..... 101/147, 366, 148; 239/545, 423, 433, 443, 444, 446, 447, 448

[56] References Cited

U.S. PATENT DOCUMENTS

| | | | |
|---|---|---|---|
| 3,986,673 | 10/1976 | Beck | 239/423 |
| 4,064,801 | 12/1977 | Switall | 101/366 |
| 4,146,900 | 3/1979 | Arnold | 101/35 |
| 4,469,024 | 9/1984 | Schwartz et al. | 101/147 |
| 4,831,927 | 5/1989 | Lin | 101/148 |

*Primary Examiner*—Edgar S. Burr
*Assistant Examiner*—C. Bennett

[57] ABSTRACT

A printing press dampener includes an elongated body member having a first and second passage provided therein. The first passage is connected to a supply of dampening fluid and the second passage is connected to a supply of pressurized gas. A plurality of chambers disposed along the length of the elongated body are in communication with both the first and the second passages. Fluid and gas run within these chambers. A plurality of spray nozzles, one in communication with each of the chambers, are positioned to spray dampening fluid against the dampener of the offset printing press.

10 Claims, 2 Drawing Sheets

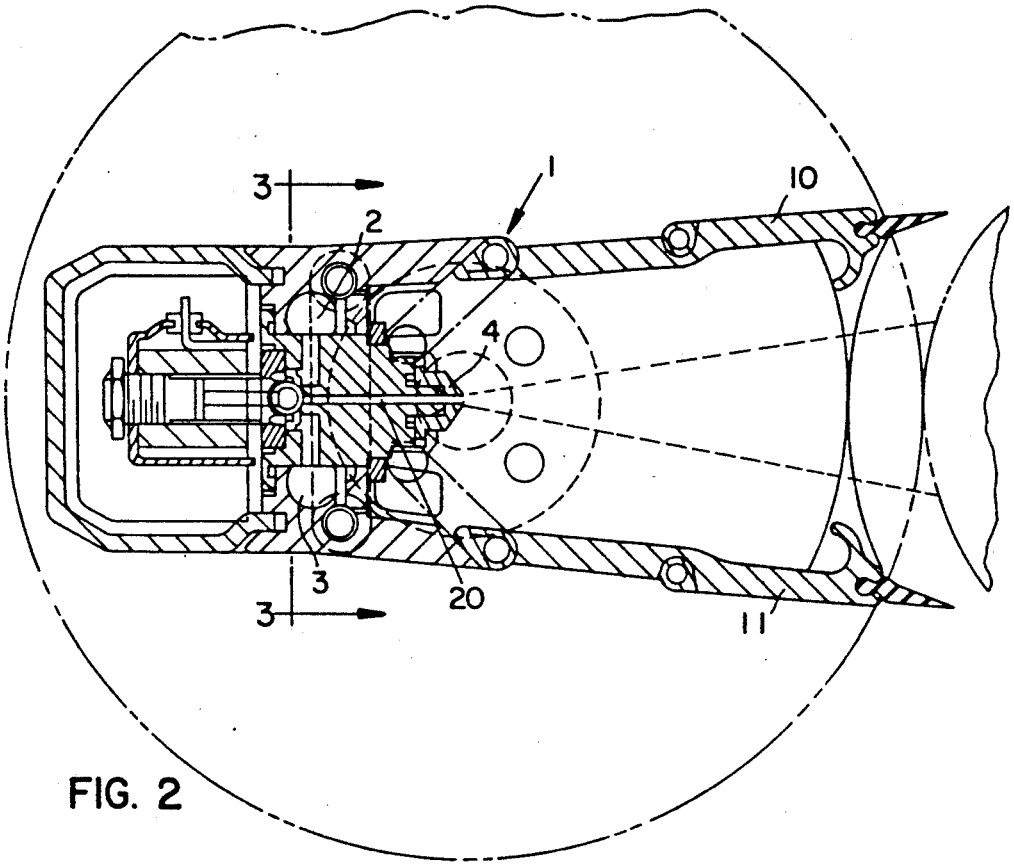
FIG. 2
FIG. 3
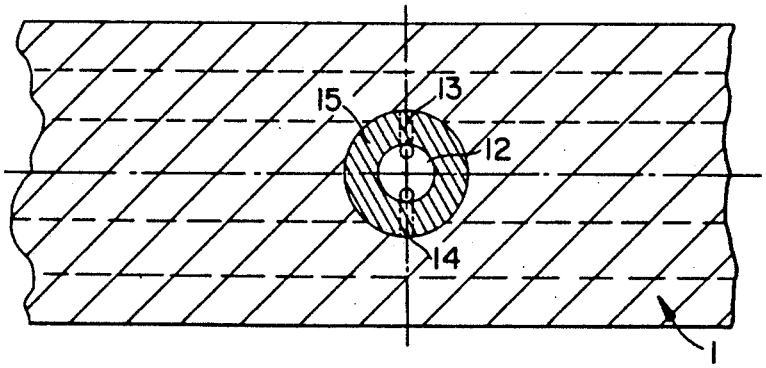

PRINTING PRESS DAMPENER

This application is related to the subject matter of U.S. Pat. No. 4,831,927, issued May 23, 1989, entitled "Printing Press Dampener", the disclosure of which is incorporated herein by reference.

BACKGROUND OF THE INVENTION

1. Field of the Invention

This invention relates to offset lithographic printing presses having a spray rail and series of spray nozzles for supplying dampening fluid to the press during printing operations. More particularly, this invention relates to an improved spray rail that creates a more even spray pattern over the dampener of a printing press for improved quality of prints, by introducing air into the dampener solution prior to exit through the spray nozzles.

2. Description of Prior Art

Lithography is the art or process of printing from a flat stone or metal plate. Lithography is distinguished from other forms of printing, in part, by the absence of relief to distinguish between the areas to be printed and those to be left blank. The lithographic method is based upon the repulsion between immiscible liquids, such as oil-based inks, and water. The process begins by the etching of a design on a surface. A grease-like material that is attracted to the etched area is then applied to the surface. The greased areas of the surface repel water ensuring that only ungreased areas of the surface become saturated with water. The printing ink subsequently applied will be repelled by the ungreased areas that are saturated with water and absorbed by the greased areas. This creates the design in ink on the surface.

To ensure that printing ink is not absorbed in areas that are ungreased, and thereby improve the quality of the print, a continuous supply of water must be uniformly applied to the press during the printing operation. If water is not evenly applied, stripes occur in the blank portions of the printed article. This is known as striping and can be experienced to varying degrees depending upon the uniformity of the water coverage. The more uniform the application of water, therefore, the better the quality of the resulting print.

To reduce the variations in the film of water applied to the printing plate, water is not applied directly to the plate. Instead, water is first applied to a dampener or roller and subsequently transferred to the printing plate. Although some of the irregularities in coverage can be removed by indirect application of water to the printing plate, the uniformity in water coverage on the printing plate and consequent quality of print can be further enhanced by achieving a uniform water film on the dampener or roller itself.

Various means of applying water to the dampener have been utilized in attempts to improve the uniformity of the water covering on the dampener. These include partially immersing the dampener in a fountain and the utilization of the action of flicker brushes to coat the dampener with water. Many of these however have proved to be erratic in their achievement of uniformity.

The use of a spray rail comprising a series of spray nozzles to spray fluid onto a dampener has proved quite successful. The spray pattern achieved, although fairly uniform, does result in some variation in the fluid coverage achieved. Over long periods of time, the spray nozzles are prone to clogging. The blockages created may merely reduce the uniformity in spray coverage and therefore the quality of a print. Alternatively, the blockages may completely block the exit of fluid from the spray nozzle creating large areas of dark striping on the final print. When the nozzles are completely blocked, the press must be stopped for cleaning of the nozzles. The frequent stoppages necessary to clean the nozzles reduces operating efficiency. It is desirable therefore to be able to consistently apply a uniform film of water to the printing plate so that prints of higher quality can be consistently achieved. For this reason it is also desirable that nozzle clogging be reduced.

The printing press dampener of this invention applies a water film of improved uniformity to the printing press by improving the uniformity of the spray emitted from the spray rail and reducing the likelihood of blockage. This is achieved by introducing air into the water spray prior to exit through the spray nozzles.

OBJECTS OF THE INVENTION

Accordingly it is an object of this invention to provide an improved printing press dampener that meets the aforementioned needs.

It is a specific object of this invention to provide a printing press dampener that consistently applies a more uniform film of water to the press plate.

It is a further object of this invention to provide a printing press dampener that is less prone to clogging.

It is another object of this invention to provide an improved spray rail printing press dampener that enables the same area of coverage of the dampener to be achieved by the spray nozzles with lower fluid pressure.

SUMMARY OF THE INVENTION

In accordance with one embodiment of this invention an improved printing press dampener which achieves the foregoing objects includes an elongated body member having a first and a second passage provided therein. The first passage is connected to a supply of dampening fluid and the second passage is connected to a supply of pressurized gas. A plurality of chambers are disposed along the length of the elongated body member and are in communication with both the first and the second passages. Fluid, including both water and gas, are mixed within these chambers. A plurality of spray nozzles, one in communication with each of the chambers, are positioned to spray dampening fluid against the dampener of the offset printing press. The mixing chamber is preferably a valve chamber having a valve preferably of the solenoid valve type. The dampener fluid and pressurized gas are preferably introduced separately to opposite sides of the valve body for mixing.

BRIEF DESCRIPTION OF THE DRAWINGS

For a more complete understanding of this invention, reference should now be made to the embodiment illustrated in greater detail in the accompanying drawings and described by way of example only. In the drawings:

FIG. 2 is a sectional view through the printing press dampener of FIG. 1 at a spray nozzle.

FIG. 3 is a sectional view through the printing press dampener of FIG. 1 in a direction transverse to that of FIG. 2.

DETAILED DESCRIPTION OF THE DRAWINGS

Figure 1:
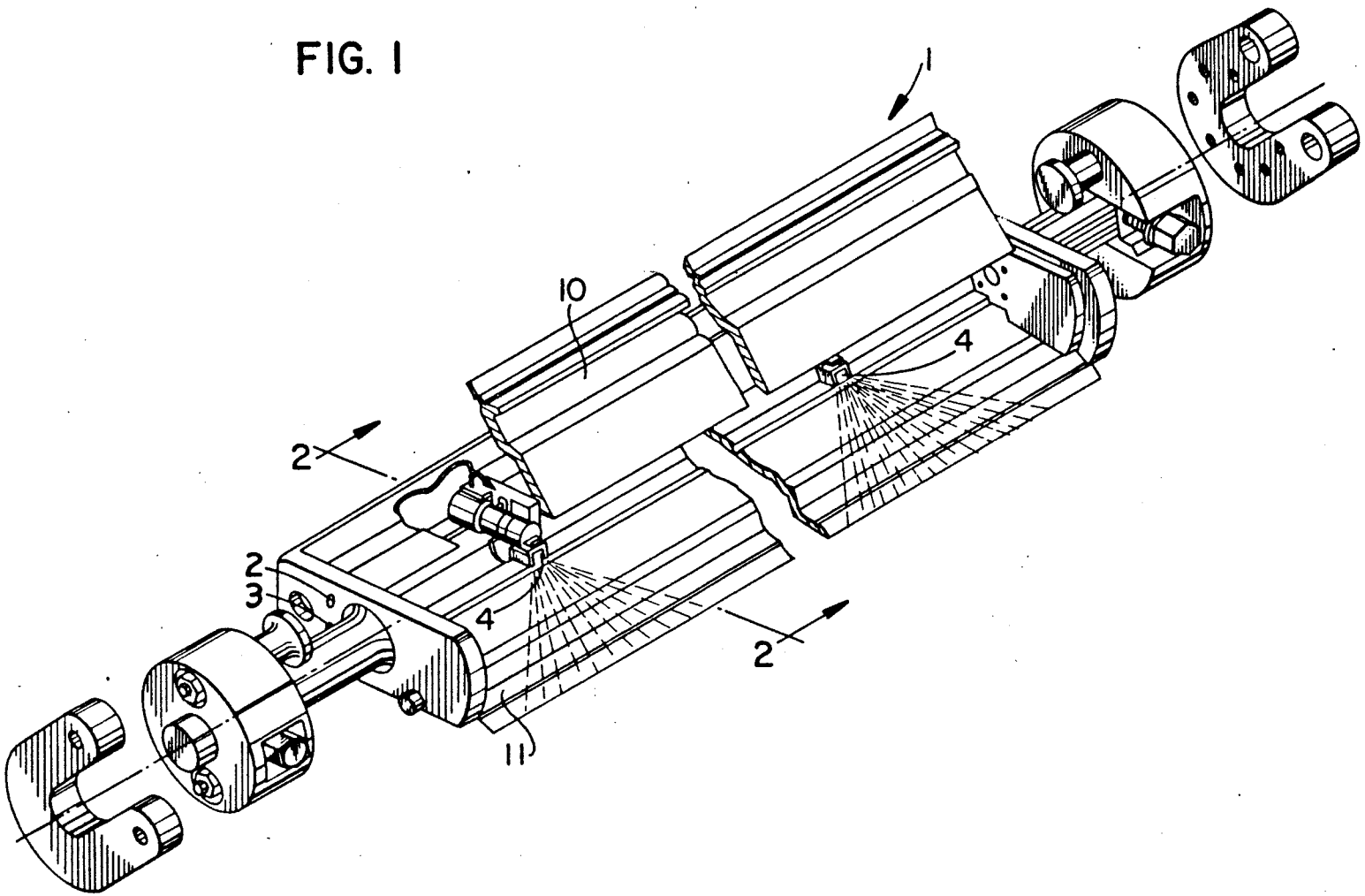
FIG. 1 is a perspective view of printing press dampener.

Turning to FIG. 1, a perspective view of a printing press dampener spray rail can be seen. An elongated rail 1 has passages 2 and 3 provided for connection to a supply of pressurized dampening fluid and pressurized air, respectively, from a supply of air and of dampening fluid (not shown). A plurality of spray nozzles 4 are disposed along the length of the elongated rail 1. The nozzles 4 spray dampening fluid against a dampener roller for transfer onto a press plate. The nozzles 4 may be of any desired type but in this particular embodiment are solenoid operated valves. Each solenoid operator is connected to a source of electrical power by means of electrical connections that enter the rear portion of the rail 1. Spray shields 10, 11 confine the spray from the nozzles and extend across the entire breadth of the rail 1.

FIGS. 2 and 3 show more clearly the solenoid valve and the manner in which pressurized air and dampening fluid are mixed in the valve chamber 12 for expulsion through the spray nozzle 4. The pressurized air and the pressurized dampener fluid enter the solenoid valve separately from opposite sides of the valve body 15 through passages 13 and 14, respectively. When the solenoid valves 15 are turned on, the dampener fluid and air mix in the solenoid valve chamber 12. The fluid-/air mixture then passes through the orifice 20 of the valve and sprays at the spray nozzles 4.

By mixing air with the dampener solution a more evenly distributed fluid spray pattern is obtained from the spray nozzle. This results in reduced striping in the finished print and thereby improves quality. The pressurized air passing through the narrow orifice 20 helps to keep the spray nozzle clean and thus reduce clogging. Clogging at a spray nozzle can prevent the spray rail from adequately covering the dampener with fluid causing prints to be of inferior quality. By reducing the likelihood of clogging, the down-time of the press is reduced, enabling the printing process to be accomplished more efficiently.

A further advantage over existing spray rail dampeners is achieved by the use of solenoid valves with larger diameter nozzles that, as a result of the additional air pressure, can be utilized at lower flow rates of dampener fluid. By using a larger nozzle diameter, a greater area of fluid coverage can be achieved at a lower flow rate. In such a nozzle, the pressurized air causes the dampening fluid to fan to give this effect. To obtain the optimum spray pattern it is preferable to hold the pressure in the air to 2 psi below that of the pressure in the dampening solution. The pressures of the two supplies are preferably both be between 30 and 40 psi.

While one preferred embodiment of this invention is illustrated, it will be understood, of course that the invention is not limited to this embodiment. Those skilled in the art to which the invention pertains may make modifications and other embodiments employing the principles of the invention, particularly upon considering the foregoing teachings.

What is claimed is:

1. A spray rail for supplying dampening fluid to an offset printing press having a dampener, comprising:

an elongated body member disposed adjacent said dampener, said body member having a first passage provided therein for connection to a supply of dampening fluid and a second passage provided therein for connection to a supply of pressurized gas;

at lest one chamber disposed along the length of said elongated body member and in communication with said first and second passages, said chamber operatively connected for mixing dampening fluid from said first passage with pressurized gas from said second passage;

at least one spray nozzle in communication with said chamber for spraying the mixture of dampening fluid and pressurized gas against the dampener; and a narrow orifice connecting said chamber to said spray nozzle, said narrow orifice containing said mixture of dampening fluid and pressurized gas.

2. The spray rail of claim 1 wherein said gas and dampening fluid are mixed in a valve chamber.

3. The spray rail of claim 2 wherein said gas and dampening fluid enter said valve chamber from opposite sides of said valve body.

4. The spray rail of claim 3 wherein said valve is a solenoid valve.

5. The spray rail of claim 3 wherein said gas is air.

6. A spray rail for supplying dampening fluid to an offset printing press having a dampener, comprising:

an elongated body member disposed adjacent said dampener, said body member having a first passage provided therein for connection to a supply of dampening fluid and a second passage provided therein for connection to a supply of pressurized gas;

a plurality of chambers disposed along the length of said elongated body member and in communication with said first and second passages, each of said chambers operatively connected for mixing dampening fluid in said first passage with pressurized gas in said second passage;

a plurality of spray nozzles disposed along the length of said elongated body member, said nozzles being in communication with said chambers in a one-to-one correspondence to permit spraying the mixture of dampening fluid and pressurized gas against the dampener; and a plurality of narrow orifices, a respective narrow orifice connecting a respective chamber to its associated spray nozzle, each of said narrow orifices containing said mixture of dampening fluid and pressurized gas.

7. The spray rail of claim 6 wherein said gas and dampening fluid are mixed in a valve chamber.

8. The spray rail of claim 7 wherein said gas and dampening fluid enter said valve chamber from opposite sides of said valve body.

9. The spray rail of claim 8 wherein said valve is a solenoid valve.

10. The spray rail of claim 6 wherein said gas is air.

* * * * *